United States Patent [19]

Coombs

[11] 4,122,782

[45] Oct. 31, 1978

[54] FOLDING SHELVING

[76] Inventor: John F. Coombs, 531 Main St., Worcester, Mass. 01608

[21] Appl. No.: 787,945

[22] Filed: Apr. 15, 1977

[51] Int. Cl.[2] ..... A47B 3/00

[52] U.S. Cl. ..... 108/111; 108/149; 211/118; 211/149; 312/6

[58] Field of Search ..... 108/99, 100, 111, 149; 211/113, 118, 149, 90; 312/6

[56] References Cited

U.S. PATENT DOCUMENTS

| | | | |
|---|---|---|---|
| 1,225,607 | 5/1917 | Ford et al. | 108/111 |
| 1,448,539 | 3/1923 | Hopwood | 108/111 |
| 1,847,066 | 3/1932 | Berg | 312/6 |
| 2,244,887 | 6/1941 | Manley | 312/6 |
| 3,904,258 | 9/1975 | Faulkenberry | 108/111 X |

FOREIGN PATENT DOCUMENTS

| | | | |
|---|---|---|---|
| 1,179,557 | 5/1959 | France | 312/6 |

*Primary Examiner*—James C. Mitchell
*Attorney, Agent, or Firm*—Charles R. Fay

[57] ABSTRACT

Folding shelving in a single unit comprising a series of rigid shelves connected at the edges thereof to a flexible side wall extending over and under the same at the top and bottom, wherein the shelving is supported by a single member attached to a wall or standard, and providing for a peaked uppermost compartment and an oppositely extending peaked lowermost compartment.

5 Claims, 6 Drawing Figures

FIG. 3
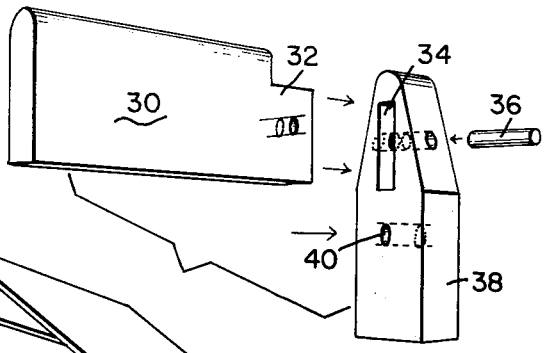
FIG. 1
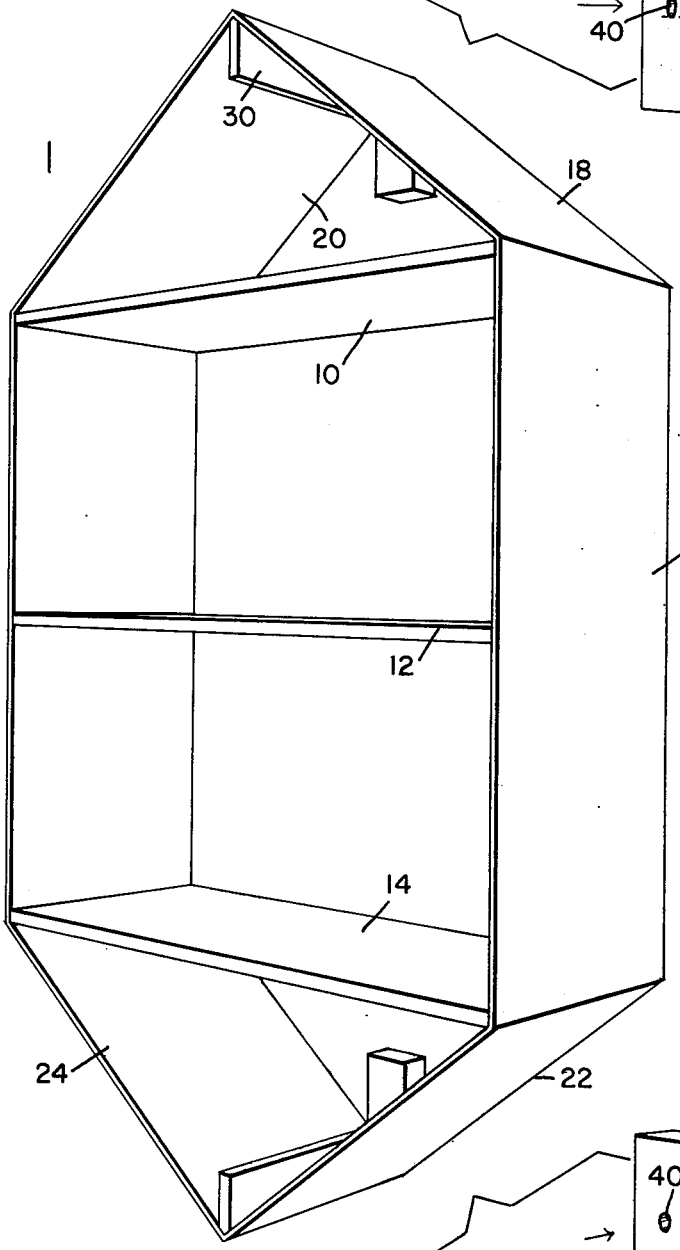
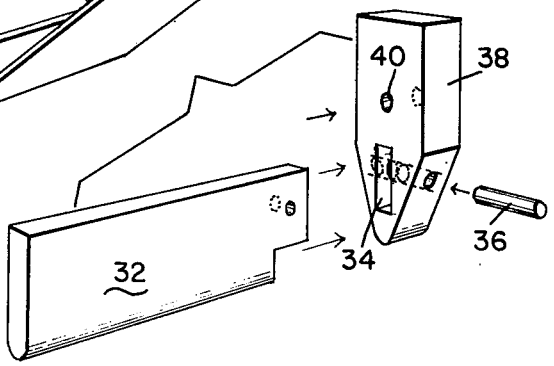
FIG. 2

FIG. 4
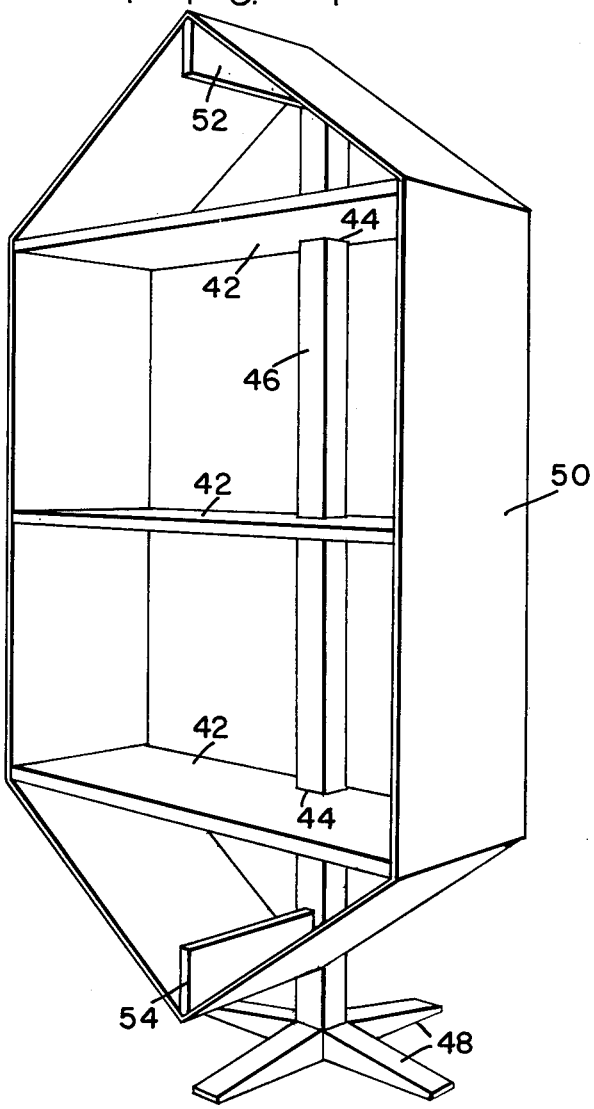
FIG. 5
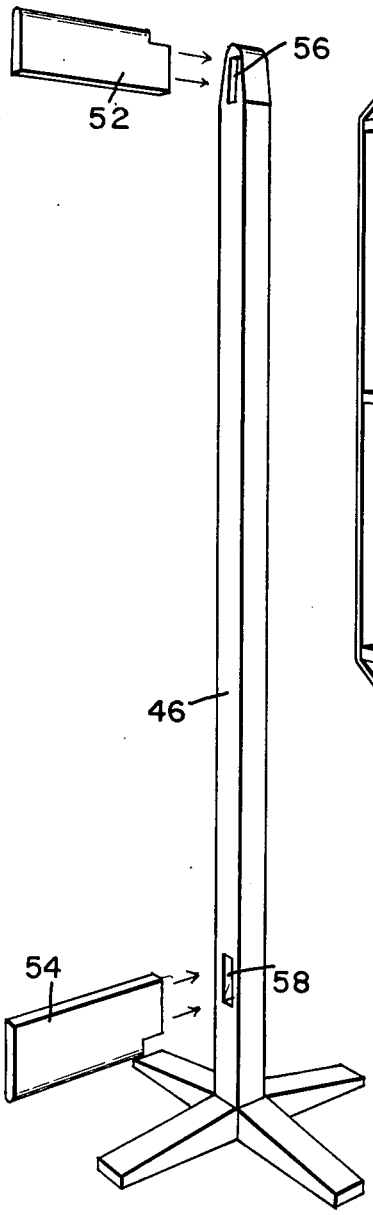
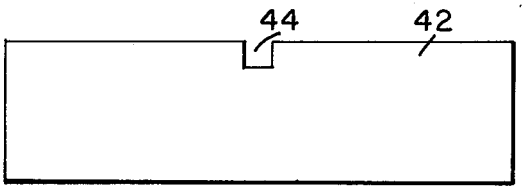
FIG. 6

FOLDING SHELVING

BACKGROUND OF THE INVENTION

Many forms of folding shelving have been suggested but such shelving has ordinarily been provided in rectangular form with a rigid top and bottom shelf; and it is the purpose of the present invention to provide folding shelving in which the upper and lower compartments are V shaped.

SUMMARY OF THE INVENTION

As illustrated in the present invention, a series of shelves, i.e. three in number, are provided, and these shelves are connected at their ends to a flexible surrounding member such as for instance, plastic, canvas or the like, there being a top and bottom shelf, and the top shelf having over it a portion of the surrounding flexible material longer than the length of the shelf, so that it can be supported by means of a single member attached to a wall or standard thereby providing a inverted V shaped top compartment. Similar construction at the lowermost part of the shelving forms a lowermost compartment which is V shape in configuration.

BRIEF DESCRIPTION OF THE FIGURES

FIG. 1 is a perspective view illustrating a form of the invention;

FIG. 2 is an exploded perspective view illustrating a connection for the lowermost compartment;

FIG. 3 is a similar view illustrating a connection for the uppermost compartment.

FIG. 4 is a perspective view illustrating a modification;

FIG. 5 is an exploded perspective view illustrating a standard support for the modification of FIG. 4; and FIG. 6 is a plan view of any one of the three shelves of FIG. 4.

PREFERRED EMBODIMENT OF THE INVENTION

Referring now to FIG. 1 there are shown three shelves 10, 12 and 14. These shelves are shown as rectangular in nature with smooth edges and at the ends thereof they are connected by any means desired whether mechanical or adhesive to a flexible surrounding belt-like member generally indicated at 16.

The member 16 may be plastic, canvas or any suitable material, and extends completely around the three shelves having excess material as at 18 and 20 at the top and as at 22 and 24 at the bottom. Parts of the belt at 18 and 20 are considerably longer than shelf 10, and parts of the flexible material as at 22 and 24 are considerably longer than shelf 14.

This allows provision for a supporting member 30 which may be secured by tenon and mortise 32, 34, and cross pin 36 in a member 38 which is adapted to be secured to a wall or the like not shown by any means convenient or desired such as another pin not shown in opening 40.

This results in the structure shown in FIG. 1 at the top of shelf 10 wherein a compartment is provided which is inverted V shape in nature and the entire shelving is supported by a single member only 30.

The same but inverted structure is illustrated to stretch members 22 and 24 to form the V shaped storage compartment which utilizes the members 22, 24 and shelf 14 as the top member. The reference numerals in FIG. 3 are the same as those in FIG. 2 and the construction is the same but inverted.

As a modification of this device the same structure can be utilized as shown in FIGS. 4 and 5, wherein each shelf 42, 42, 42 is notched as at 44 for the reception of an upright standard 46 at what may be termed the rear aspect of the construction, standard 46 fitting in the notches 44, and being mounted in any way desired as by a base 48. The same surrounding flexible belt 50 is used which is the same as that at 16, as well as supports 52 and 54, which are morticed into portions of the standard 46 adjacent the ends thereof as at 56, 58.

In order to collapse and fold the shelving unit of the present invention it is merely necessary to empty it and lift it from the respective supports 30, 32 or 52 and 54, let the three shelves come into contacting relationship, and then fold over the excess material of the top and bottom flexible portions as at 18, 20, 22, 24 in FIG. 1.

I claim:

1. A folding shelving unit comprising a plurality of shelves of like length and width, a flexible belt surrounding the same being secured thereto at the ends thereof, said belt having at the top thereof a length of material greater than the length of the shelf adjacent thereto, and a single rigid top supporting member under the same at the top portion thereof forming a top compartment of inverted V shape, and means rigidly supporting the supporting member.

2. The folding shelving of claim 1 including a bottom length of flexible belt material under the lowermost shelf exceeding in length the length of the latter, and a rigid lowermost member in position to hold the flexible material underneath the lowermost shelf in a V shape conformation, the lowermost member being rigidly supported on the means supporting the top supporting member.

3. The folding shelving of claim 1 wherein the means supporting the supporting member is a wall.

4. The folding shelving of claim 1 wherein the means supporting the top supporting member is a standard.

5. The folding shelving of claim 4 including a second rigid supporting member extending from said standard and holding the bottom compartment in the shape of a V and in fixed relation thereto.

* * * * *